US005993181A

United States Patent [19]

Hudelmaier

[11] Patent Number: 5,993,181

[45] Date of Patent: Nov. 30, 1999

[54] PROCESS AND DEVICE FOR FEEDING CONCRETE OR OTHER THICK MATERIALS

[75] Inventor: Gerhard Hudelmaier, Silvanerweg 19, 89075 Ulm, Germany

[73] Assignees: Gerhard Hudelmaier; Ulrike Hudelmaier; Gotz Hudelmaier; Jorg Hudelmaier, all of Ulm, Germany

[21] Appl. No.: 08/930,687

[22] PCT Filed: Jan. 19, 1996

[86] PCT No.: PCT/EP96/00228

§ 371 Date: Jan. 6, 1998

§ 102(e) Date: Jan. 6, 1998

[87] PCT Pub. No.: WO96/24767

PCT Pub. Date: Aug. 15, 1996

[30] Foreign Application Priority Data

Feb. 7, 1995 [DE] Germany ..... 195 03 986

[51] Int. Cl.[6] ..... F04B 15/02

[52] U.S. Cl. ..... 417/900; 417/519; 417/532

[58] Field of Search ..... 222/255, 252, 222/275, 278, 279, 280; 417/517, 518, 519, 900, 539, 531, 532; 137/625.45, 625.2

[56] References Cited

U.S. PATENT DOCUMENTS 3,663,129 5/1972 Antosh ..... 417/900

4,533,300 8/1985 Westerlund et al. ..... 417/517

5,458,470 10/1995 Mannhart et al. ..... 417/517

*Primary Examiner*—Andres Kashnikow

*Assistant Examiner*—Dinh Q. Nguyen

*Attorney, Agent, or Firm*—Nilles & Nilles SC

[57] ABSTRACT

A apparatus for feeding concrete and other thick materials from a container into a feeding pipe by two feeding cylinders which are alternately connectable by a switching device to the container or the feeding pipe. The feeding pistons of the feeding cylinders alternately perform a suction stroke and a pressure stroke, with the average piston speed being at least temporarily greater during the suction stroke than during the pressure stroke. A continuous feeding flow is achieved in that during the switching period $t_u$ of the switching device the two feeding cylinders are substantially separated from the container at least temporarily and are short-circuited together to form a joint conenction with the feeding pipe. In this state, the one feeding piston is still finishing its pressure stroke while the other feeding piston already begins its pressure stroke at the same time. The corresponding feeding piston will not perform its suction stroke before the short-circuit has been substantially cancelled again and the associated feeding cylinder is solely connected to the container.

9 Claims, 11 Drawing Sheets

PROCESS AND DEVICE FOR FEEDING CONCRETE OR OTHER THICK MATERIALS

BACKGROUND OF THE INVENTION

1. Field of the Invention

The present invention relates to a method for feeding concrete or other thick materials from a container into a feeding pipe by means of two feeding cylinders which are alternately connectable by a switching device to the container or the feeding pipe, with the feeding pistons of the feeding cylinders alternately performing a suction stroke and a pressure stroke, and the average piston speed during the suction stroke being at least temporarily greater than during the pressure stroke, and to an apparatus for performing the method.

2. Description of the Related Art

A corresponding method and a corresponding apparatus are known from German patent specification 3525003. The gist of the known method consists in the feature that the first feeding cylinder has not yet finished its pressure stroke, while the second feeding cylinder already starts with its pressure stroke at a lower feeding speed. After the first feeding cylinder has finished its pressure stroke, the switching operation of the switching device is started, while the second feeding cylinder continues its feeding operation at a lower feeding speed. Such a procedure has the effect that the concrete in the second feeding cylinder is already advanced, so that after the switching operation of the switching device the concrete column in the feeding pipe has no chance to perform an excessive rebound movement. This method, and the apparatus used therefor, have proved to be successful in general. However, in the present technical field, demands for more and more efficient methods for concrete feeding machines have been made recently. For instance, serious attempts have been made to increase the length of the feeding pipe and thus, in particular, the feeding height. Since in the known method the pumping operation is carried out at a reduced feeding speed during the switching period, a small pulsation is created in the feeding flow. Such a pulsation could be disregarded under the feeding conditions which have so far prevailed, but will lead at the feeding heights that are now demanded, and thus at the great lengths, for instance in the case of an arm of a concrete conveying vehicle, to vibrations at the feeding pipe end.

OBJECTS AND SUMMARY OF THE INVENTION

It is therefore the object of the present invention to provide a method and an apparatus for feeding concrete from a container into a feeding pipe, whereby irregularities in the feeding flow are further reduced.

According to the present invention such an object is achieved by a generic method in which during the switching period $t_u$ of the switching device the two feeding cylinders are substantially separated from the container at least temporarily and are short-circuited together to form a joint connection with the feeding pipe, and in this state the one feeding piston is still finishing its pressure stroke and the other feeding piston already starts its pressure stroke at the same time, with the corresponding feeding piston performing its suction stroke not before the short circuit has substantially been cancelled again and the associated feeding cylinder has been connected to the container.

A mere feeding at a reduced feeding rate is avoided by the inventive method during the switching period $t_u$. This is accomplished by short-circuiting the two feeding cylinders which in the short-circuited state can alternate during the feeding operation at a full feeding speed without any losses in the switching period. As a result of the short-circuiting operation, the concrete column is automatically compressed in the feeding cylinder which starts the pressure stroke. Pulsation impacts are avoided in this method by the continuous feeding flow provided for. The method of the invention is suited in a particularly advantageous manner for concrete pumps having a single switching device (for instance a single pivot pipe) which cooperates with the two feeding cylinders at the same time.

In an advantageous variant of the method, even more attention is paid to the characteristics of the material to be pumped. Such attention is paid in that the feeding piston which has terminated its suction stroke already starts with its pressure stroke during a time interval $\Delta t$ of the switching period $t_u$ while the other feeding piston has not yet finished its pressure stroke. A precompression of the concrete column in one of the feeding cylinders is already made possible by this measure, so that, for instance, gas inclusions or not fully filled feeding cylinders do not lead to unintended feeding variations. In a further variant it certainly suffices when the speed of the feeding cylinder which begins the pressure stroke within time interval $\Delta t$ is smaller than the average speed during the remaining pressure stroke. The beginning of the pressure stroke of the one feeding cylinder can be chosen with respect to its start time and its speed in such a manner that all of the losses to be taken into account and thus all variations caused for, e.g., by the material to be fed can be compensated for. In a further variant of the present method, the two feeding pistons can substantially be moved at half the average speed $V_1$ of the remaining pressure stroke during the time interval. This has the advantage that switching from one feeding piston to the other one can be carried out almost stepwise, since the partial feeding flows add up to the continuous total feeding flow.

The method of the invention is advantageously performed with an apparatus which comprises at least two feeding cylinders that are alternately connectable by a switching device to a container or a feeding pipe, with the feeding pistons of the feeding cylinders alternately performing a suction stroke and a pressure stroke, and the switching device being a pivot pipe which is pivotable with its inlet opening along the open end portions of the feeding cylinders. The apparatus is particularly characterized in that the inlet opening and the surrounding closing regions of the pivot pipe are designed such that during a switching operation the feeding cylinders are substantially short-circuited with the feeding pipe, but are substantially separated from the container.

This apparatus has the advantage that use can be made of apparatuses which are known in principle and in the case of which the switching device must just be designed differently in the form of a pivot pipe. This pivot pipe must ensure with its inlet opening according to the invention that a short-circuit of the two feeding cylinders is established at least temporarily during the pivoting operation or switching operation.

Advantageously, the inlet opening may be designed in the form of an elongated hole which is substantially bent around the pivot axis of the pivot pipe and has a length which corresponds approximately to the outer distance of the two feeding cylinder openings. To achieve a reliable separation of the feeding cylinders from the container, the closing regions may be arranged in extension of the elongated hole and have a width which corresponds substantially to the diameter of the feeding cylinder openings. Any short-circuiting between a feeding cylinder which performs the pressure stroke and the container is thereby avoided.

Preferably, the apparatus is controlled hydraulically; to this end there may be provided in a first embodiment a respective cylinder/piston unit in which a selectively switchable line leads into the chamber of each cylinder at the piston side, with an additional pump being arranged for further supply of pressurized fluid to the two pressure chambers of the second cylinder/piston unit, with the pressure chambers of the cylinder/piston unit at the front side of the piston having extended thereinbetween a connecting line of the hydraulic system in which a line ends that is selectively connectable via a switching valve to the additional pump or to a pressurized-fluid return means, with the sections of the line between each cylinder and the mouth of the line respectively containing a check valve which is closable by the pressure of the cylinder, and the cylinders of the cylinder/piston units in the end portion of their piston rod side comprising a line which connects the cylinders and which is also connectable via the switching valve selectively to the pressurized-fluid return means or the additional pump. The additional pump for supplying pressure to the cylinder/piston unit which starts the piston stroke ensures that no drive energy has to be taken away from the feeding piston which still performs a pressing operation. The energy supply to the piston which is to move can be started in a simple manner in due time and in an exact amount. Since the pressure of the hydraulic pump which exceeds the pressure from the additional pump is present at the cylinder/piston unit in the pressure stroke mode, and is thus present at the check valve associated with said unit, it is only the other piston to be moved that can be activated thereby. This is also true for the standstill time of the piston which has completed the pressure stroke. Furthermore, the additional pump provides for a speed of the piston in the suction stroke mode which is higher than the one in the pressure stroke mode.

In a second embodiment, the cylinder/piston units can be actuated independently in that the cylinder/piston units are each supplied with pressurized fluid via a separate pump. With such a design, speed and switching cycles can be provided in response to the respective actuation of the pumps.

In a third embodiment of the apparatus, the sequence of the method according to the invention can be achieved by providing a respective cylinder/piston unit for driving the feeding pistons, in which unit a selectively switchable line of a first pump is connectable to or separable from the chamber of each cylinder at the piston rod side, that a second pump for supplying pressurized fluid to the two pressure chambers at the front side of the piston is connectable via a switchable line either individually or jointly to the pressure chambers, and that the chambers of each cylinder at the piston rod side are jointly connectable to a pressurized-fluid return means. The different piston speeds are achieved through the pump control and the surface ratio of piston to piston rod. Furthermore, according to this embodiment the two pistons move at the same speed during the pressure stroke, the control operation being normally performed such that in this state the one piston finishes its pressure stroke and the other one begins said stroke. When the second pump provides for a constant feeding flow, the flow of pressurized fluid is halved and distributed over the two cylinders, so that these will move at half the speed, but nevertheless will jointly generate a constant feeding flow.

In a third embodiment, there is respectively provided a cylinder/piston unit for driving the feeding piston, wherein a selectively switchable line of a first pump is respectively connectable via a controllable flow divider jointly to the pressure chamber of each cylinder at the front side of the piston and to the chamber of each other cylinder at the piston rod side and is separable therefrom, with a second pump for supplying pressurized fluid to the pressure chambers at the front side of the piston being connectable via a switchable line either individually or jointly to the pressure chambers, the lines of the flow dividers which lead to the pressure chambers of the cylinders at the front side of the piston being respectively connectable jointly with the pressure chambers or can be blocked together, and wherein the flow dividers are jointly connectable to a pressurized-fluid return means when these are separated from the first pump. The different actuation is substantially to be controlled by the pumps in this arrangement. This apparatus is finely adjusted by the second pump.

To dispense with a second pump in a fifth embodiment, there is respectively provided a cylinder/piston unit for driving the feeding pistons wherein a selectively switchable line of a pump is connectable to or separable from the chamber of each cylinder at the piston rod side, wherein a second selectively switchable line of this pump is jointly connectable to or separable from the pressure chambers of the cylinders at the front side of the piston, and wherein the pressure chambers of the cylinders at the front side of the piston are jointly connectable to a line and wherein the pressure chambers at the front side of the piston are jointly connectable to or separable from a pressurized-fluid return means via a selectively switchable line. In this hydraulic circuit the volume displaced in the pressure chamber at the front side of the piston ensures that the other piston is moved accordingly. Since the line is selectively connectable to the pressurized-fluid return means, it is possible to influence the volume flow pressed through the line.

Furthermore, a respective cylinder is advantageously connected at its end at the front side of the piston via a control line to the control connection side of the check valve which is assigned to the other cylinder. The pivot pipe can be operated by means of a slide via a controlled two-way valve which is connected to a pump and/or an accumulator.

BRIEF DESCRIPTION OF THE DRAWINGS

An embodiment of the present invention will now be explained in more detail in the following text with reference to a drawing, in which.

DESCRIPTION OF THE PREFERRED EMBODIMENTS

Figure 1:
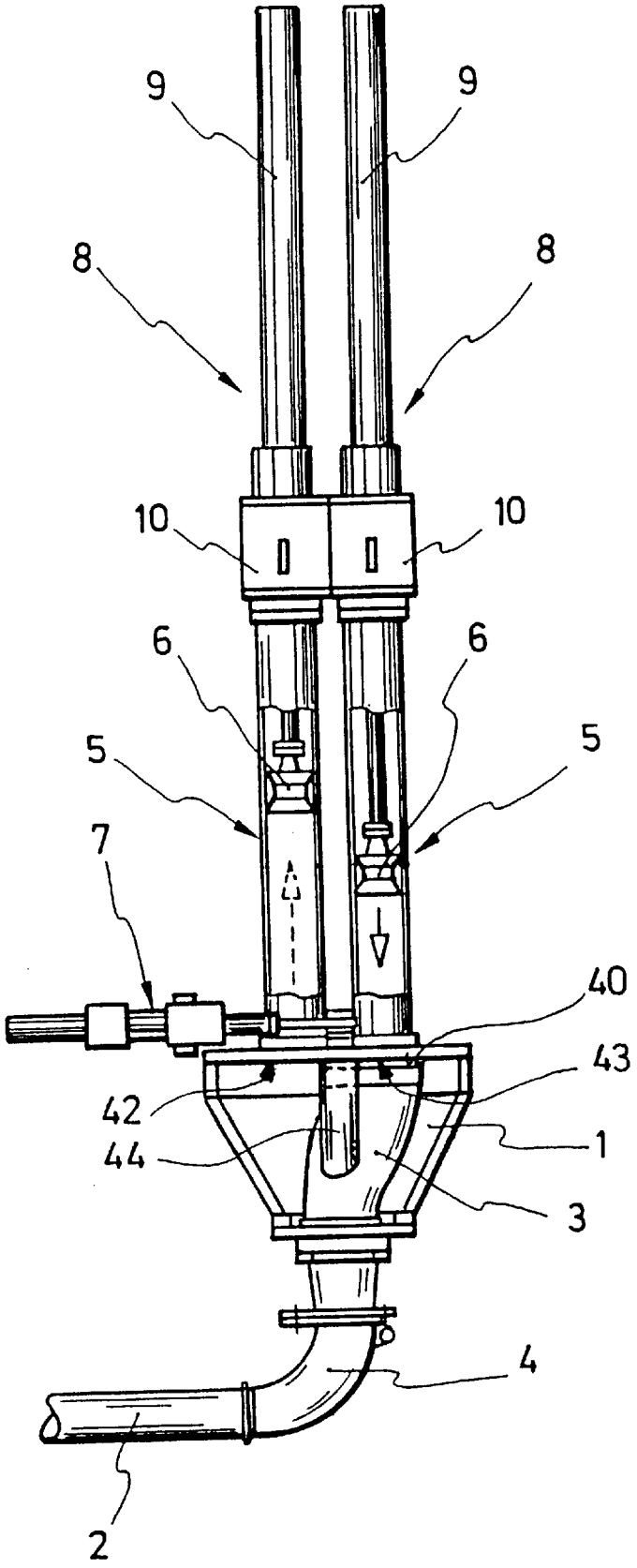
FIG. 1 is a diagrammatic, partly cut-away view of a feeding apparatus for feeding concrete.

The feeding device which is shown in FIG. 1 is a top view on an approximately funnel-shaped container 1 for receiving concrete, for instance, from concrete mixer trucks. Concrete is fed into a supply pipe 2 (not shown in more detail) via a pivot pipe 3 and an elbow 4. This feeding operation is performed by means of two feeding cylinders 5 whose feeding pistons 6 alternately perform a respective suction stroke and a respective pressure stroke. The pivot pipe 3 is hydraulically pivotable via a slide 7 into its respectively desired position with respect to the mouth of the two feeding cylinders 5. In FIG. 1, the mouth of the sucking feeding cylinder 5 is open towards container 1, so that the cylinder is filled from the direction of said mouth (see the arrow shown in broken line).

The feeding pistons 6 are moved by means of cylinder/piston units 8, of which only cylinders 9 are schematically shown in FIG. 1. Housings 10 are arranged at the junction point between the feeding cylinders 5 and the cylinder/piston units 8. As will still be described further below, the pivot pipe 3 is funnel-shaped in this embodiment, so that the two feeding cylinders 5 are simultaneously connectable to feeding pipe 2 at least temporarily.

Figure 2:
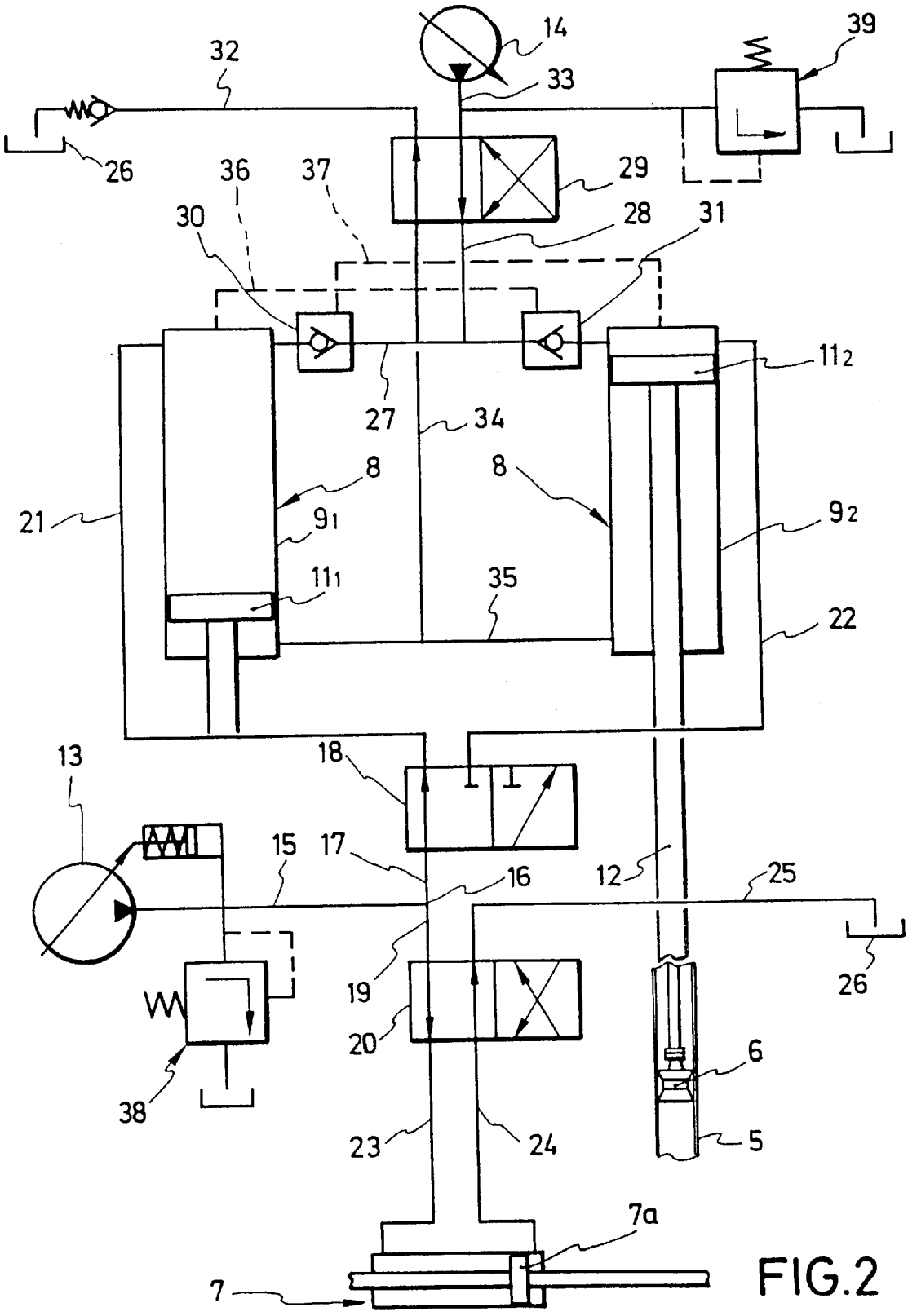
FIG. 2 shows a first embodiment of a simplified hydraulic connection diagram for the drive means of the apparatus.

FIG. 2 shows a first embodiment of a simplified diagram of a hydraulic system for operating the cylinder/piston units 8 and the feeding pistons 6 coupled therewith. A feeding cylinder 5 and a feeding piston 6 are shown in a fragmentary and schematic manner in combination with one of the cylinder/piston units 8. Slide 7, which is also operated by the hydraulic system, is shown in a schematic manner as well.

Each cylinder/piston unit 8 comprises a piston 11 whose motional sequence is transmitted via its piston rod 12 to the feeding piston 6.

The drive means for the cylinder/piston units during the pressure stroke is substantially implemented by a hydraulic pump 13. An additional pump 14 supplies additional feeding flow for specific motional phases of the pistons. The hydraulic network comprises the following sections:

A line 15 leads from the hydraulic pump 13 to a junction point 16, and a line 17 extends from said point to a two-way valve 18, and a line 19 to a switching valve 20. A line 21 leads from the two-way valve 18 into the portion of a cylinder $\mathbf{9}_1$ which is at the front side of the piston (the indices 1 and 2 will be used hereinafter for the two piston/cylinder units whenever the motional sequences of the two units are described).

A line 22 leads from the two-way valve 18 into the pressure chamber of cylinder $\mathbf{9}_2$ which is at the front side of the piston. Lines 21 and 22 are thus connectable by the two-way valve 18 to the hydraulic pump 13 in a selective manner.

A line 23 leads from the switching valve 20 to the one side and a line 24 to the other side of a piston 7*a* in slide 7. Moreover, a line 25 leads from the switching valve 20 to the return means 26 in such a manner that in response to the respective valve position, one side of slide 7 is connected to the hydraulic pump 13 and the respectively other side to the return means 26.

A line 27 connects the two piston face portions of cylinders $\mathbf{9}_1$ and $\mathbf{9}_2$ each other. A line 28 is branched off between the two members to a switching valve 29. In front of the mouth of line 28 which leads into cylinders $\mathbf{9}_1$ and $\mathbf{9}_2$, line 27 includes a check valve 30 and 31, respectively, each having its closing direction towards line 28.

A line 32 leads from switching valve 29 to return means 26, and a line 33 to the additional pump 14. Moreover, a line 34 leads from switching valve 29 into the area of the cylinder/piston units where it terminates in a line 35 which connects the portions of cylinders $\mathbf{9}_1$ and $\mathbf{9}_2$ at the rod side. This line does not contain any valves.

A control ine 36 extends between the portion of cylinder $\mathbf{9}_1$ at the piston side and the control connection side of the check valve 31. Likewise, cylinder $\mathbf{9}_2$ is connected via a control line 37 to the check valve 30.

A pressure control valve 38 is assigned to the hydraulic pump 13, and a pressure control valve 39 to the additional pump 14.

With the above-described apparatus and with an additional controlled switching system for the switching valves 20, 29 and the two-way valve 18, it is possible to obtain a motional sequence of the pistons 11 which will be described hereinafter with reference to FIGS. 3–7. The motional sequence is analogously applicable to the feeding pistons 6, thereby defining the supply of concrete from the container 1 into the supply pipe 2.

A first variant of the method according to the present invention will now be described in more detail with reference to FIGS. 3 to 5 using the above-described apparatus.

Figure 3:
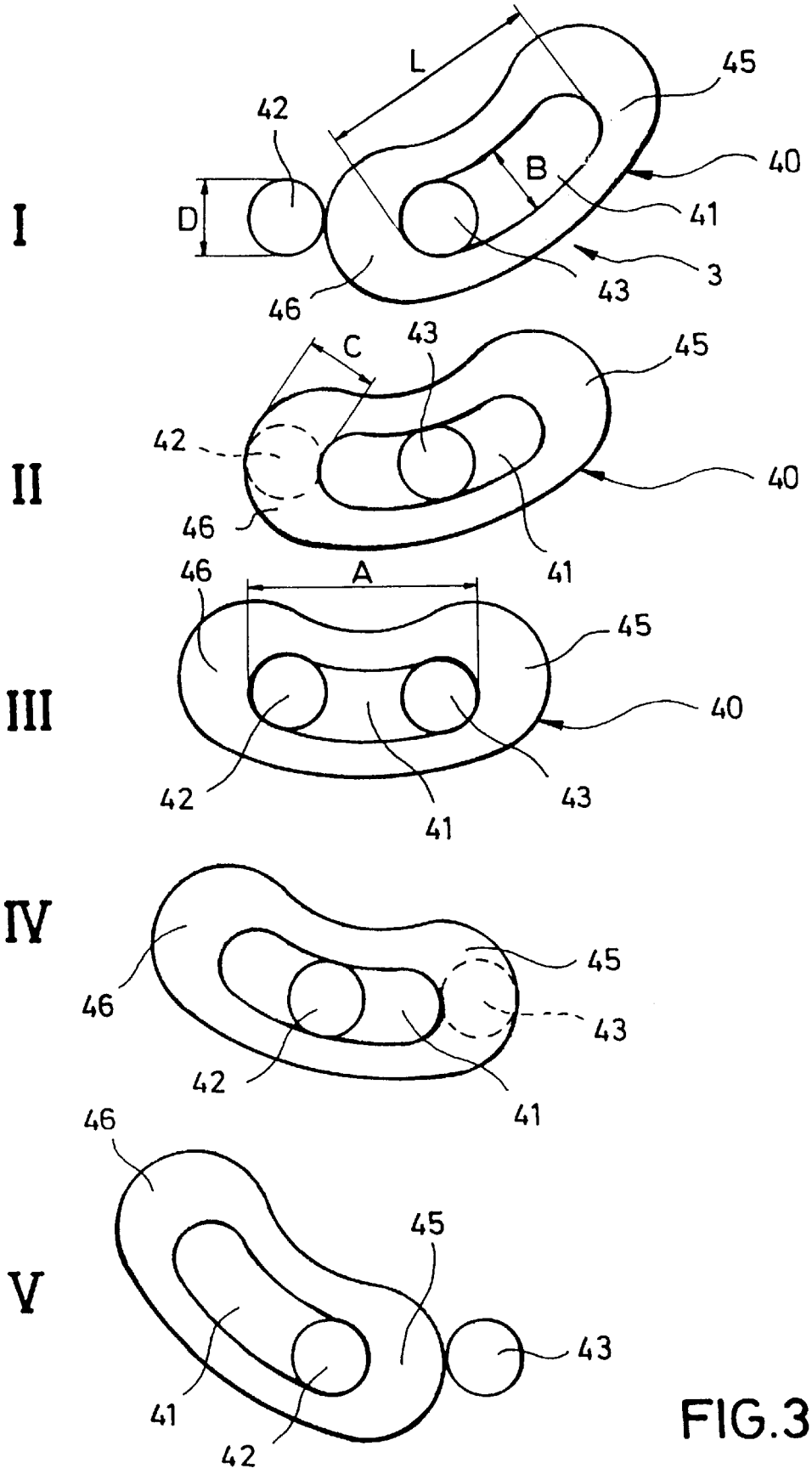
FIG. 3 shows a schematic connection diagram showing the front side of the pivot pipe which faces the feeding cylinder.
Figure 4:
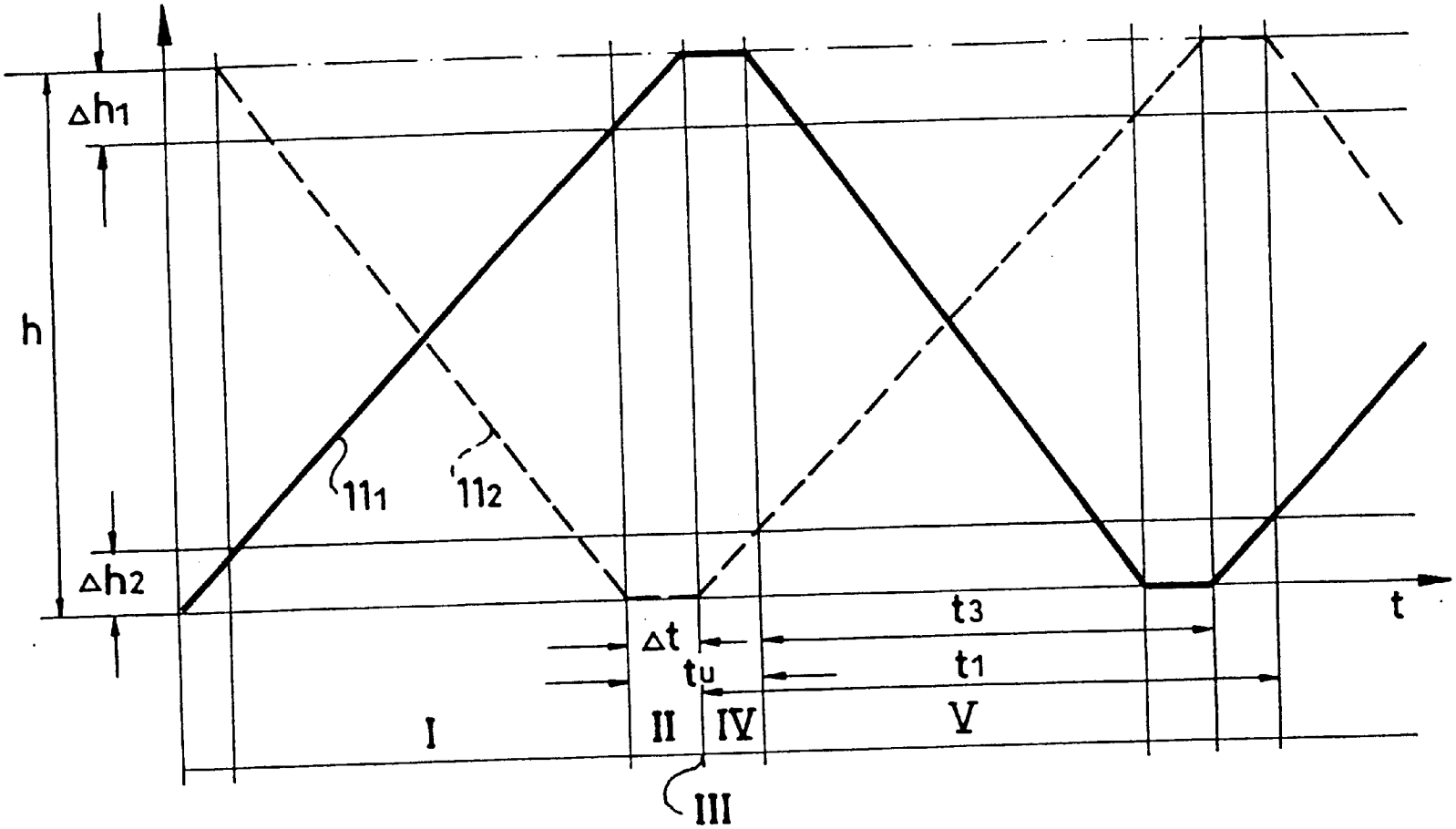
FIG. 4 shows a displacement/time diagram of the two feeding cylinders according to a first variant of the method of the present invention.

As can specifically be seen in FIG. 3, the front side 40 of the pivot pipe 3 which faces the feeding cylinders 5 is substantially kidney-shaped. The front side 40 includes a bow-shaped inlet opening 41 whose width B corresponds substantially to the diameter D of the mouth openings 42, 43 of the feeding cylinders 5. The length L of the inlet opening 41 corresponds to the outer distance A of the two mouth openings 42, 43. Hence, the inlet opening 41 has the shape of a bent elongated hole whose bow center is located in the pivot axis 44 of pivot pipe 3. Furthermore, the front side 40 is respectively provided at the end of inlet opening 41 with closing regions 45, 46 whose minimum distance C from the inlet opening 41 to the outer edge corresponds to the diameter D of the mouth openings 42, 43. Starting from the front side 40 of the pivot pipe 3, the pipe extends in funnel-shaped fashion towards its second end which is connected to feeding pipe 2. The inlet opening 41 is here also reduced in funnel-shaped fashion towards the corresponding opening at the opposite end. Apart from the transition states, it is substantially possible, thanks to the inventive design of pivot pipe 3, to achieve the five states shown in FIG. 3, which are of decisive importance to the control of the system.

In the following description, the corresponding positions of pistons $\mathbf{11}_1$ and $\mathbf{11}_2$ will be assigned to the respective position of the pivot pipe 3 with reference to FIGS. 3 to 5.

Figure 5:
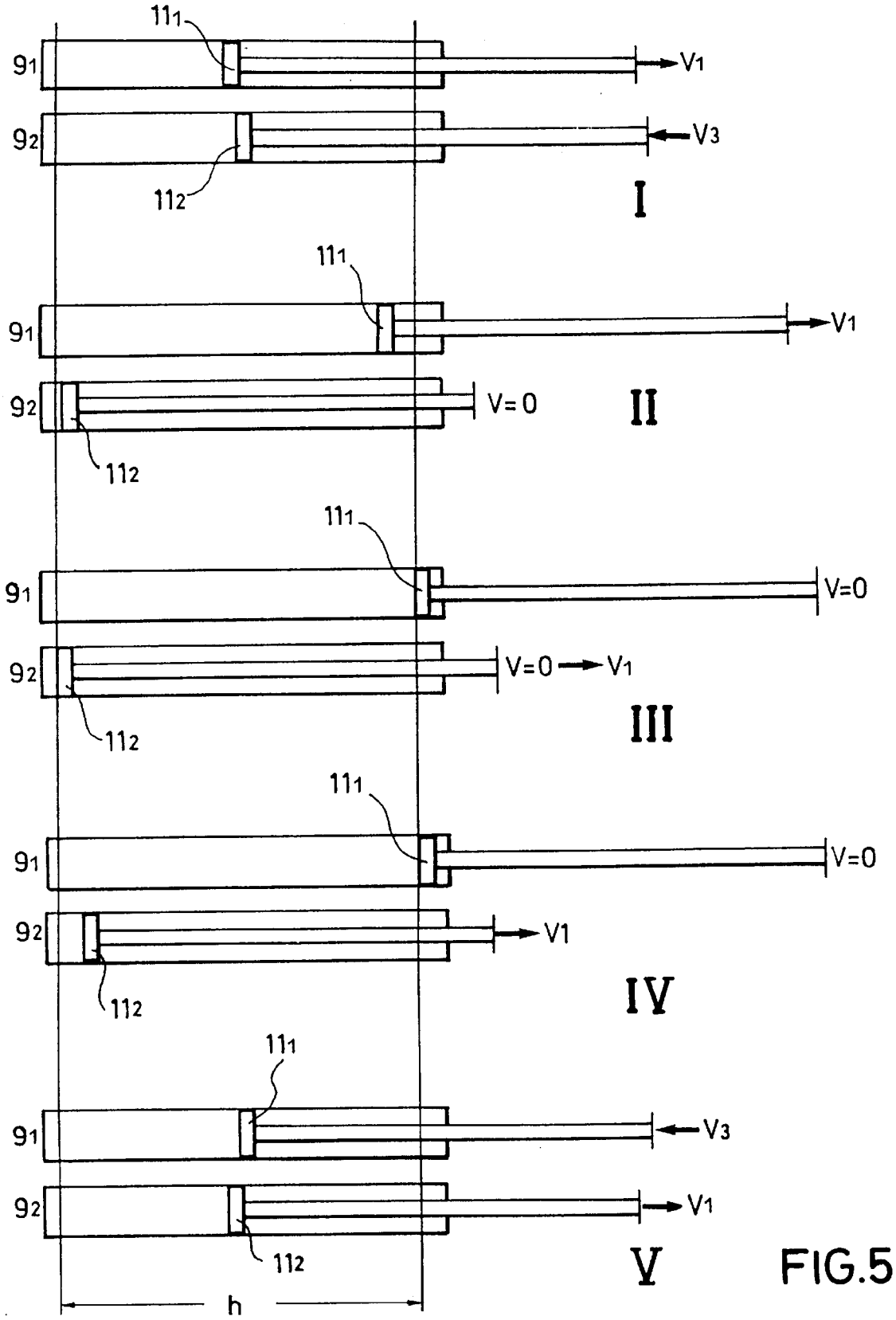
FIG. 5 shows five operative positions of the piston/cylinder units according to the diagram of FIG. 4.

The initial position for phase I is the position of the pistons and the pivot pipe, as shown in FIGS. 3 and 5. The hydraulic pump 13 acts on cylinder $\mathbf{9}_1$ with a pressure $P_1$ via line 15, valve 18 and line 21. At the same time, the hydraulic pump 13 keeps the slide 7 in a position which is at the right side in the figure, namely via lines 15, 19 and 23 and via valve 20. The right side of the slide is connected to the outlet 26 via switching valve 20. The portions of cylinders $\mathbf{9}_1$ and $9_2$ at the rod sides are connected via lines 35, 34 and via switching valve 29 to the return means 26. The additional pump 14 is connected via lines 33, 34 and 35 and via valve 29 to the end of pistons $11_1$, $11_2$ at the piston rod side. The additional pump 14 will act with a pressure $P_2$ on cylinders $9_1$ and $9_2$ in the respective portions thereof at the piston rod side by switching switching valve 29. Pressure $P_2$ is smaller than pressure $P_1$.

Therefore, piston $11_1$ will press the liquid to be displaced by it upon pressure into line 35 against pressure $P_2$. At the rod side, piston $11_1$ is acted upon by pressure in addition to the effect of pump 14. Its return stroke is carried out at speed $V_3$. This stroke movement corresponds to the suction stroke of the associated feeding piston 6.

Since speed $V_3$ is higher than speed $V_1$, piston $11_1$ has not yet finished its pressure stroke upon entry into phase II, while piston $11_2$ has already finished its suction stroke. As can be seen in the corresponding time/displacement diagram in FIG. 4, the switching period $t_u$ starts with the beginning of phase II. During a time interval Δt of the switching period $t_u$, piston $11_2$ and thus the corresponding feeding piston 6 are at a standstill. An advantage must particularly be seen in the fact that the closing region 45 of the front side 40 is not unnecessarily subjected to a high pressure. In phase II, pivot pipe 3 already pivots due to the switching of valve 20 to such an extent that the mouth opening 42 is separated from container 1.

As soon as phase II has been reached, the two mouth openings 42, 43 and thus the two feeding cylinders 5 are short-circuited with the inlet opening 41 and thus with the feeding pipe 2. In this state, the two-way valve 18 performs its switching operation. As a result, the hydraulic pump 13 is connected to the portion of cylinder $9_2$ which is at the front side of the piston. Piston $11_2$ will now perform a pressure stroke at speed $V_1$ until the end of phase IV has been reached. In phase IV, the pivot pipe 3 is pivoted further in such a manner that the closing region 45 will gradually sweep over the mouth opening 43. During this time, piston $11_1$ is at a standstill.

When the mouth opening 43 is entirely separated from inlet opening 41 and a connection is again established with container 1, the additional pump 14 is now in communication with the portions of cylinders $9_1$ and $9_2$ at the piston rod side via lines 33, 34, 35 and via switching valve 29, so that the piston $11_2$ presses the liquid to be displaced by it during the pressure stroke against pressure $P_2$ into line 35, whereby the piston $11_1$ has thus pressure applied to it at the rod side in addition to the effect of pump 14. Its return stroke will take place at speed $V_3$; see phase V. This stroke movement corresponds to the suction stroke of the associated feeding piston 6. At the end of phase III, i.e. at the beginning of phase IV, pistons $11_1$ and $11_2$ will have exactly interchanged their initial positions. The further sequence will correspond to the sequence described above, only with correspondingly interchanged pistons and a correspondingly interchanged pressure application.

Thus, the motional sequence of the pivot pipe 3 as shown in FIG. 3 takes place between the end of phase I and the beginning of phase V, i.e., during the switching period $t_u$. The switching positions assigned to the displacement/time diagram during the pivotal movement of the pivot pipe 3, see FIG. 3, are configured to be variable and need not exactly comply with this embodiment. Overlapping phases might even be desired, depending on the operational conditions. As can clearly be gathered from FIG. 4, the pressure strokes of cylinders $9_1$ and $9_2$ alternate without any time loss at the end of the time interval Δt at the same feeding speed $V_1$, thereby providing a continuous feed flow. According to the invention it is here important that the mouth openings 42, 43 of the feeding cylinder 6 are short-circuited with the inlet opening 41 and thus with the feeding pipe 2 in this state. Another important point is that both mouth openings 42, 43 are separated from container 1 and will therefore not start their suction stroke before the short-circuit has been cancelled again.

As becomes apparent from the displacement/time diagram for the pistons of the hydraulic device, which substantially corresponds to the stroke sequence of the feeding pistons for the delivery of concrete, the whole pessure stroke of a feeding piston takes more time, namely $t_1$, than the suction stroke with period $t_3$. However, the time sum of suction stroke and pressure stroke, $t_1+t_3$, will always be the same, so that the opposite directions of the piston movements at the two sides will be maintained.

Figure 6:
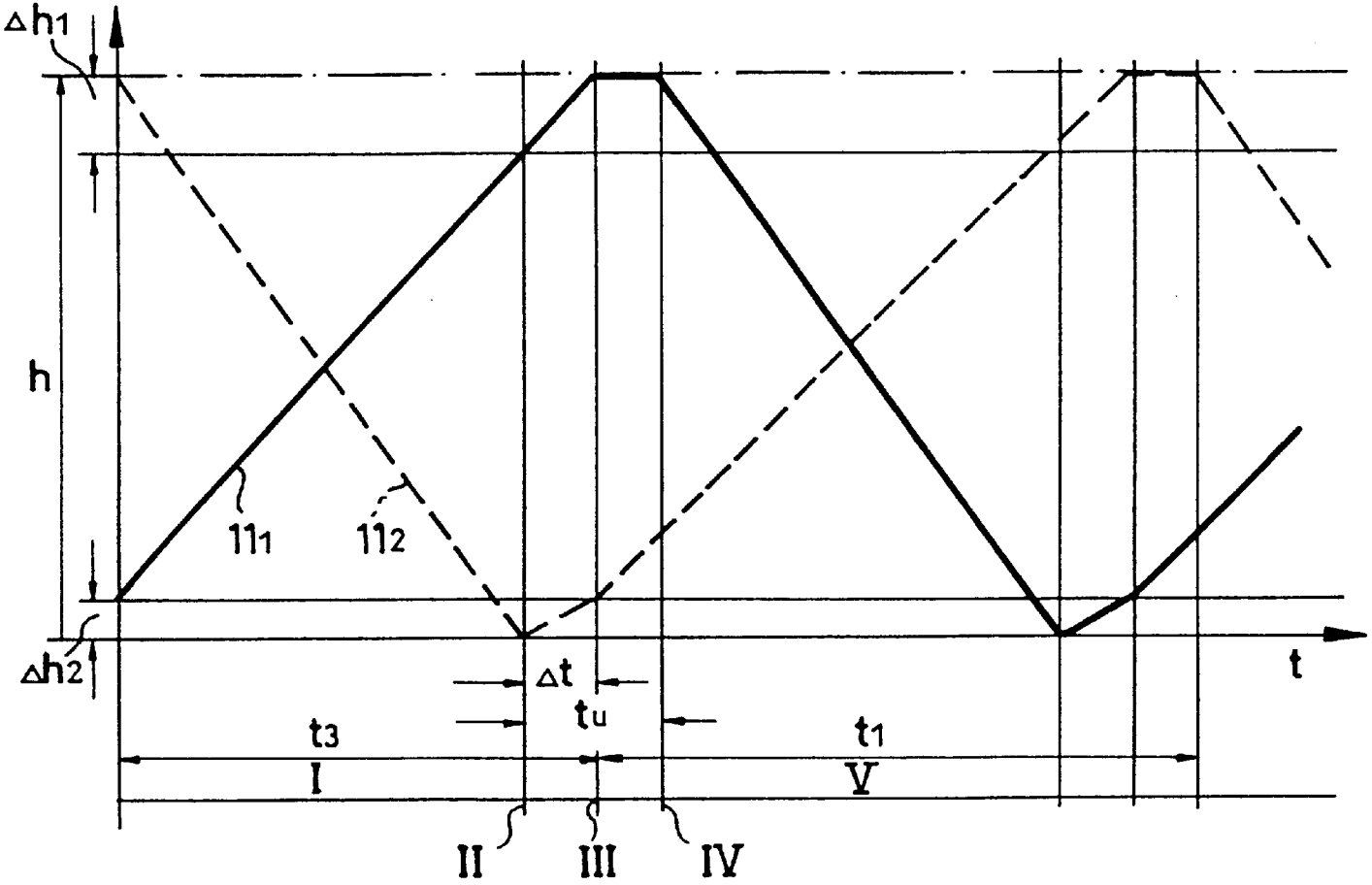
FIG. 6 is a displacement/time diagram of a second variant of the method according to the present invention.
Figure 7:
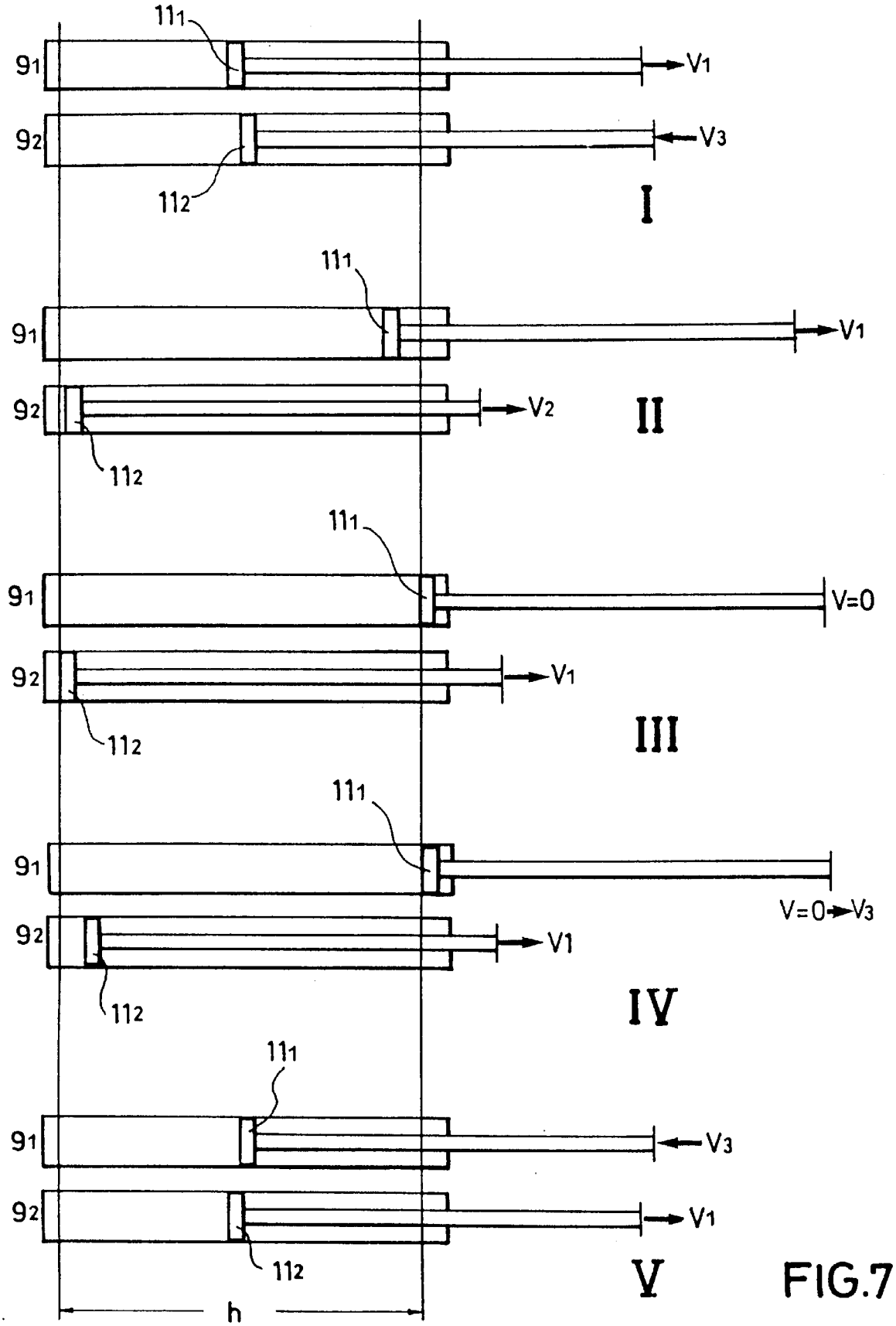
FIG. 7 shows five operative positions of the piston/cylinder units according to the second method variant of FIG. 6.

A second variant of the method according to the present invention will now be described in more detail, in particular with reference to FIGS. 3, 6, and 7. Only the essential differences with respect to the preceding embodiment will be discussed in more detail in the following text. Like reference numerals will therefore be used for like or similar method sequences and for like or similar components.

The apparatus shown in FIG. 2 is in a position, in particular due to the switching valve 29, the check valves 30, 31 and their control lines 36, 37, to prompt one of the cylinders 9 to start its pressure stroke already at a time at which the other cylinder 9 has not yet finished its pressure stroke. This is of particular advantage in cases where possible losses, for instance, caused by an inadequate filling or by air inclusions in the concrete, must be compensated for.

Starting from the end of phase I, i.e. at the beginning of phase II, the additional pump 14 is connected via lines 33, 28, 27 and valves 29, 31 to the face end of piston $9_2$. Hence, the additional pump 14 acts on piston $11_2$ at a pressure $P_2$ from the beginning of phase II during period Δt until the beginning of phase III. Piston $11_1$ terminates its pressure stroke at speed $V_1$. Under the action of pressure $P_2$, piston $11_2$ will already start its pressure stroke at a speed $V_2$ which is smaller than speed $V_1$. As soon as phase III has been reached, the switching valve 29 will switch over, thereby separating the additional pump 14 from the face end of piston $11_2$. As a result of the pressure stroke at the reduced speed $V_2$ during the time interval Δt, the concrete column is already precompressed in this feeding cylinder, so that, for instance, pressure losses caused by the material can be compensated for. As a consequence, both pistons perform a pressing operation during period Δt. The one feeding piston, which is still connected via pivot pipe 3 to feeding pipe 2, completes its pressure stroke during this period and will then remain at a standstill during switching period $t_u$. Immediately at the end of its suction stroke, the other feeding piston is already moved again at a slow pace towards the pressure stroke with the aid of the additional pump 14. The concrete which has just been sucked into the cylinder in the opposite direction is thus already given an initial movement towards the mouth opening 42. After the end of time interval Δt, i.e. after short-circuiting the two mouth openings 42, 43 and after simultaneous switching to an increased oil delivery amount by the hydraulic pump 13, the speed of the feeding piston will change. Concrete is pressed from the feeding cylinder into the feeding pipe 2 without any risk of a sudden transition, an interruption or even a return movement caused by poor filling. After the end of the switching operation, i.e. after the end of time $t_u$, the other feeding piston is moved towards its suction stroke, i.e. at a faster pace than during the pressure stroke. The increase in speed is made possible by the additional pump 14. It ensures that the suction stroke is terminated at the moment at which a new pressure stroke is started by performing corresponding switching operations, i.e., before the other piston has completely finished its pressure stroke.

An important aspect of the present invention is that the described speed differences between suction stroke and pressure stroke of each piston and the adjustment in time with respect to the stroke sequence of the other feeding piston, as well as the position of the front side of the suction pipe required at the corresponding times must be matched with one another.

Further embodiments of simplified schemes of a hydraulic system will now be described in more detail with reference to FIGS. 8 to 11. However, only essential differences with respect to the scheme shown in FIG. 2 shall be discussed hereinafter; that is why like reference numerals are used for like or similar components.

It should here be noted that the schemes just cover the most important components required for fulfilling the present function.

Figure 8:
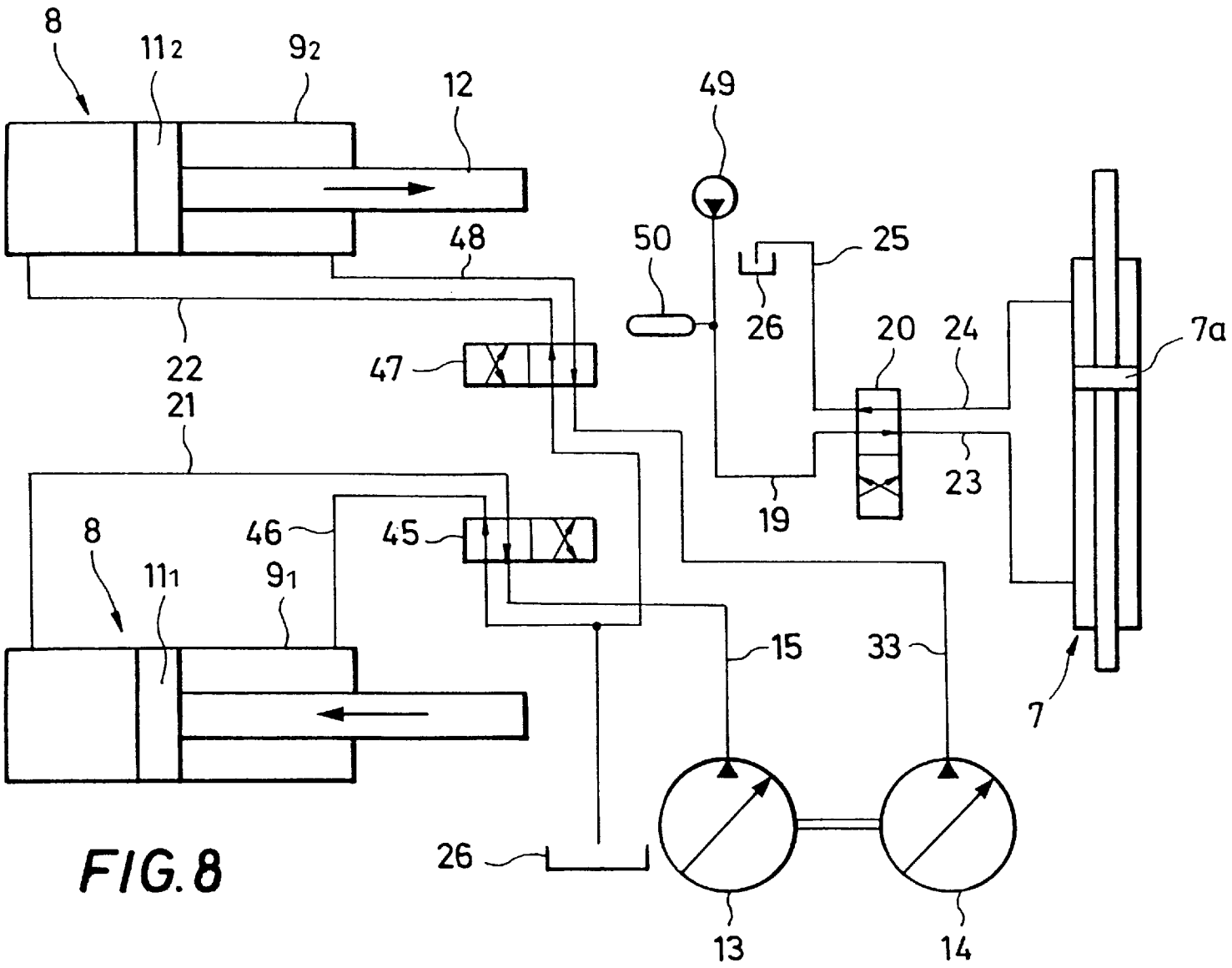
FIG. 8 shows a second embodiment of a simplified hydraulic connection diagram for the drive means of the apparatus.

The diagram shown in FIG. 8 shows two substantially equivalent displacement pumps 13, 14 for the control operation. The first displacement pump 13 communicates via line 15, a 4/2-port directional control valve 45 and a line 21 with the pressure chamber of cylinder $\mathbf{9}_1$ which is at the front side of the piston. In its other switching position, the directional control valve 45 ensures that the displacement pump 13 communicates via line 15 and line 46 with the chamber of cylinder $\mathbf{9}_1$ which is at the piston rod side. Likewise, the displacement pump 14 communicates via line 33, a 4/2-port directional control valve 47 and line 22 with the pressure chamber of cylinder $\mathbf{9}_2$ which is at the front side of the piston. In the other switching position of the directional control valve 47, the displacement pump 14 communicates via line 48 with the chamber of cylinder $\mathbf{9}_2$ which is at the piston rod side. The displacement pumps 13, 14 are adjusted to each other. As becomes apparent from the circuit, each cylinder $\mathbf{9}_1$, $\mathbf{9}_2$ can be controlled and operated separately via the associated displacement pump 13, 14. As a consequence, it is solely the actuation of the displacement pumps 13, 14 and the directional control valves 45, 47 which is responsible for the extension and retraction of the cylinders $\mathbf{9}_1$, $\mathbf{9}_2$, and the actuation thereof must be performed accordingly. Furthermore, an additional pump 49 is provided with a downstream accumulator 50 and communicates via line 19 and the 4/2-port directional control valve 20 with slide 7. The accumulator 50 ensures that pump 49 need not be operated permanently. However, an embodiment would here also be possible in which the accumulator 50 is filled by one of the displacement pumps 13, 14 during the standstill period of one of the pistons $\mathbf{11}_1$, $\mathbf{11}_2$.

Figure 9:
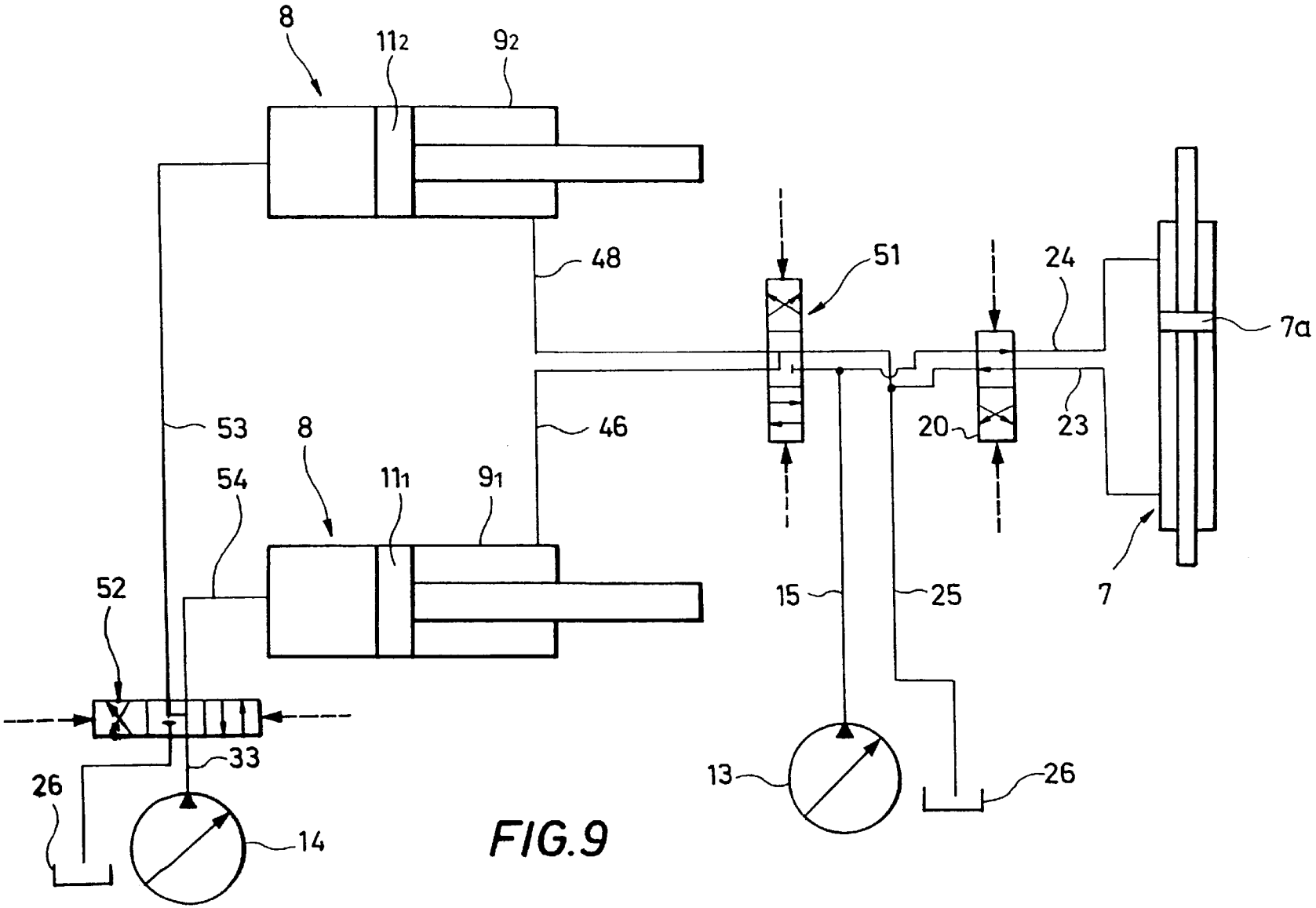
FIG. 9 shows a third embodiment of a simplified hydraulic connection diagram for the drive means of the apparatus.

The diagram shown in FIG. 9 comprises a displacement pump 13 which communicates via a line 15, a 4/3-port directional control valve 51 and lines 46, 48 with the chambers of cylinders $\mathbf{9}_1$, $\mathbf{9}_2$ which are at the piston rod side. The directional control valve 51 has a position in which the lines 46, 48 are separated from pump 13 and connected via line 25 to the pressurized-fluid return means 26. Furthermore, there is provided a second displacement pump 14 which selectively communicates via line 33, a 4/3-port directional control valve 52 and lines 53, 54 with the pressure chambers of cylinders $\mathbf{9}_1$ and $\mathbf{9}_2$ at the piston rod side. In the position shown in FIG. 9, the directional control valve 52 connects the two pressure chambers of cylinders $\mathbf{9}_1$ and $\mathbf{9}_2$ to pump 14. Thanks to the control operation via the two displacement pumps 13, 14, with the one pump effecting the pressure stroke, and the second one the respective suction stroke, the speed ratio between pressure stroke and suction stroke can be kept at a constant level by accurately activating the directional control valves 51, 52 and pumps 13, 14. In the present embodiment this is especially the case when the two cylinders $\mathbf{9}_1$ and $\mathbf{9}_2$ perform a pressure stroke for a short period of time (see valve position in FIG. 9) and the two piston rod sides of cylinders $\mathbf{9}_1$ and $\mathbf{9}_2$ are connected to the tank during this period.

At the same time, slide 7 is activated. This means that, when the short-circuit is established on pivot pipe 3, the two feeding cylinders 5 are in the pressure stroke mode at substantially half the average speed $V_1$. The stepwise switching from one to the other cylinder $\mathbf{9}_1$ and $\mathbf{9}_2$ had no influence on the total feeding flow due to the adaptation of the speeds.

Figure 10:
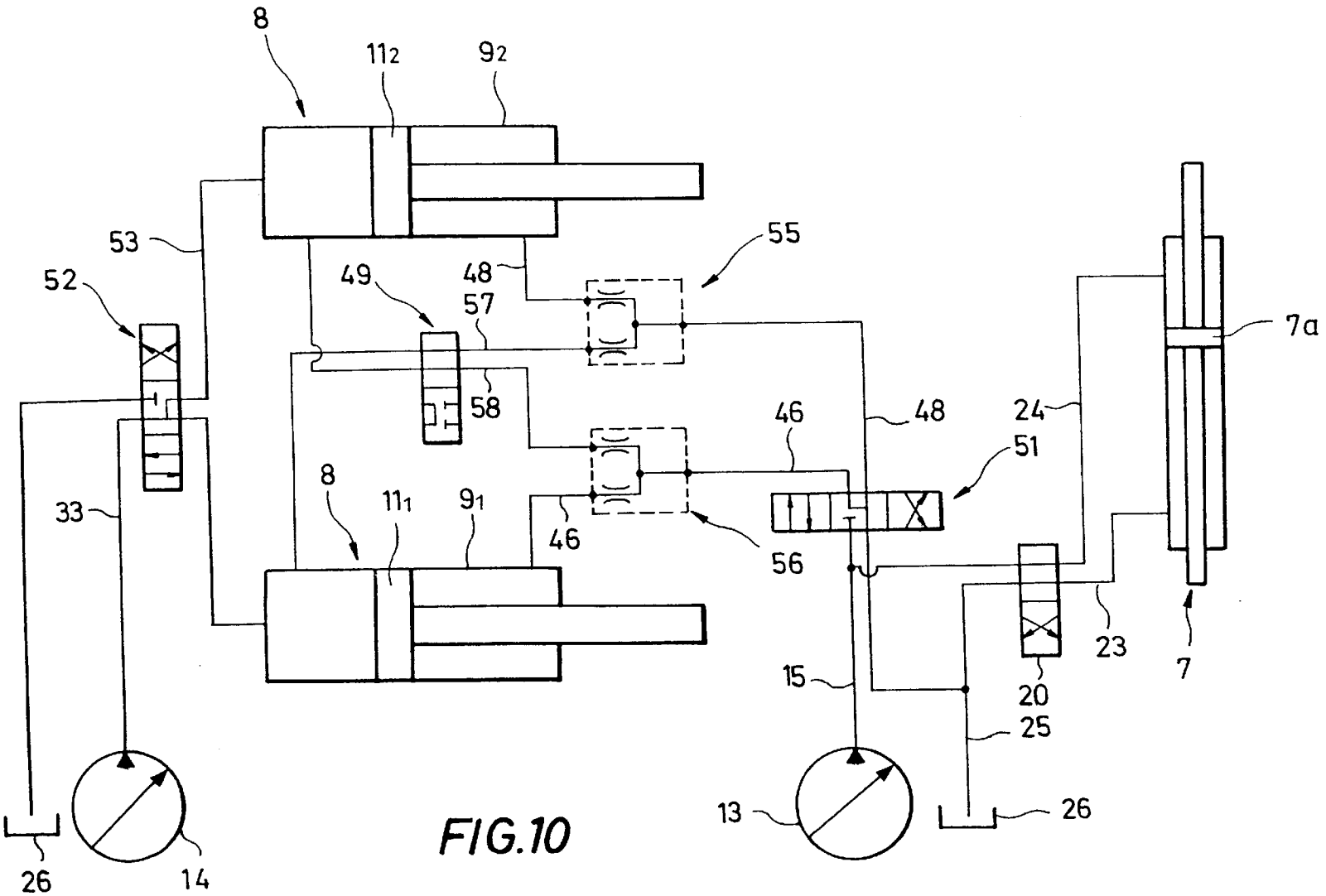
FIG. 10 shows a fourth embodiment of a simplified hydraulic connection diagram for the drive means of the apparatus.

The embodiment shown in FIG. 10 differs from the preceding one in that lines 46, 48 have respectively disposed therein after the 4/3-port directional control valve 51 an adjustable flow divider 55, 56 from which lines 46, 48 are respectively continued to the chambers of cylinders $\mathbf{9}_1$ and $\mathbf{9}_2$ at the piston rod side and a second line 57, 58 communicates via a 4/2-port directional control valve 59 with the pressure chambers of cylinders $\mathbf{9}_1$ and $\mathbf{9}_2$ at the piston rod side. In this embodiment, the pressure and suction strokes can each be produced by the displacement pump 13. During switching of the pivot pipe 3, however, the 4/3-port directional control valve 51 connects the lines 46, 48 to the pressurized-fluid return means 26, and the 4/2-port directional control valve 49 blocks the lines 57, 58, so that no oil volume can escape from the pressure chambers of cylinders $\mathbf{9}_1$ and $\mathbf{9}_2$ at the piston rod side. In this state, the displacement pump 14 is simultaneously connected to the two pressure chambers of cylinder $\mathbf{9}_1$ and $\mathbf{9}_2$ at the piston rod side. In response to the delivery volume of the displacement pump 14, these cylinders will then perform a pressure stroke at the same speed. Normally, the one cylinder is positioned shortly before its end position during this process, and the other one is at the beginning of its pressure stroke. The delivery volume of the displacement pump 14 is normally selected such that there are no variations in the feeding flow. During this process the dividing ratio of the flow dividers 55, 56 and the surface ratio of the piston face and of the piston rod side of cylinders $\mathbf{9}_1$ and $\mathbf{9}_2$ must be designed to obtain a reasonable ratio between pressure stroke speed and suction stroke speed. A fine adjustment of the apparatus is possible through the displacement pump 14 which can be adjusted accordingly for producing higher or smaller speeds.

Figure 11:
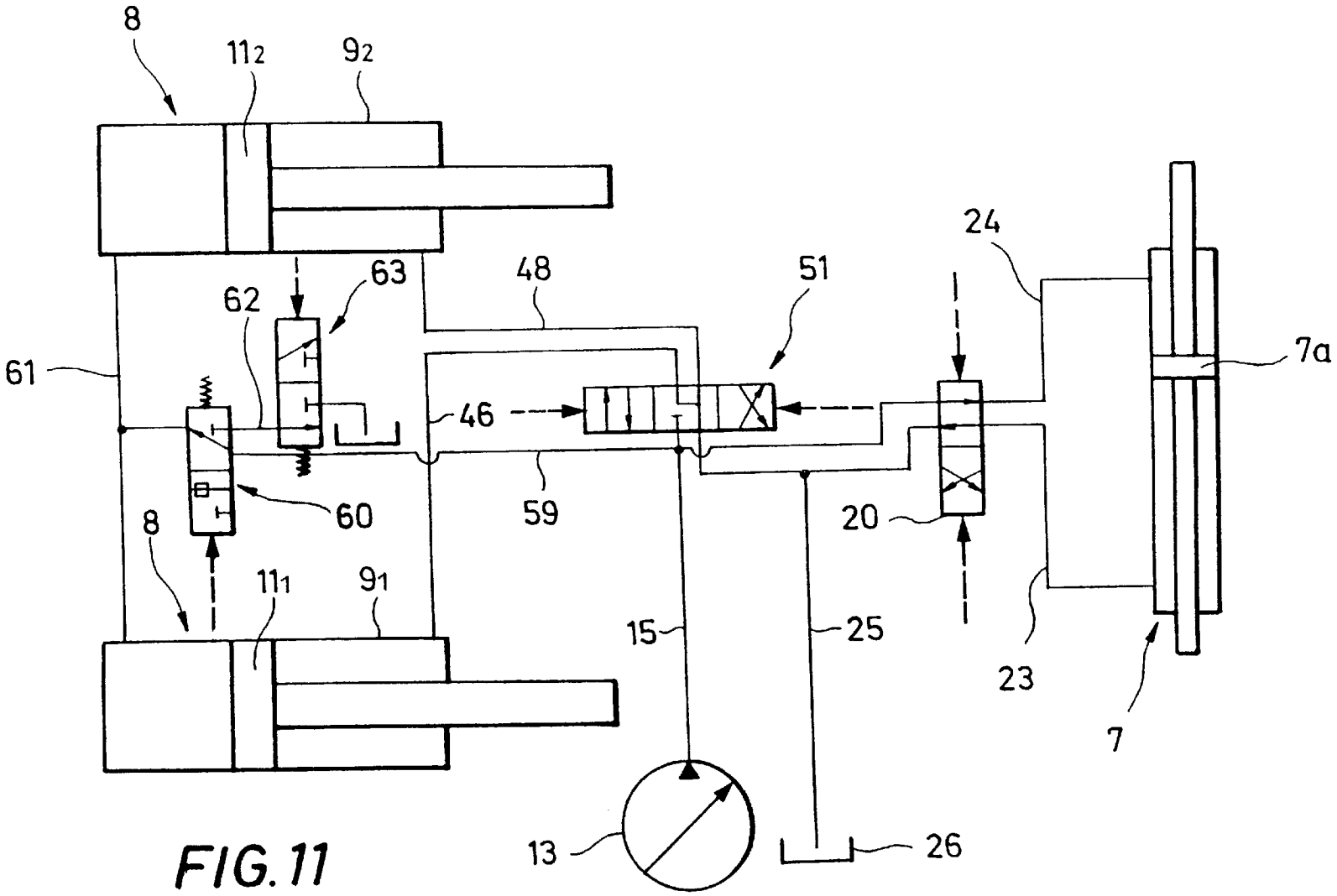
FIG. 11 shows a fifth embodiment of a simplified hydraulic connection diagram for the drive means of the apparatus.

Finally, FIG. 11 shows a fifth embodiment of a hydraulic scheme for driving the feeding cylinders 5. The line 15 leading away from the displacement pump 13 is again connected via a 4/3-port directional control valve 51 and lines 46, 48 to the chambers of cylinders $\mathbf{9}_1$ and $\mathbf{9}_2$ which are at the piston rod side. Moreover, a line 59 is branched off from line 15 in front of the directional control valve 51. Line 59 connects line 15 and thus pump 13 to a line 61 via a 3/2-port directional control valve 60. Line 61 is directly connected to the two pressure chambers $\mathbf{9}_1$ and $\mathbf{9}_2$ which are provided at the front side of the piston. A line 62 which is also connected to the 3/2-port directional control valve 60 leads via a further 3/2-port directional control valve to the pressurized-fluid return means 26. At the beginning of the suction stroke of the one cylinder, a small amount of oil is passed from line 61 via the directional control valves 60, 63 to the pressurized-fluid return means 26. The chamber of this cylinder which is at the piston rod side is then in communication with the pump 13. The oil volume from the cylinder starting the suction stroke is now pressed, minus the small anount of hydraulic fluid, via the line 61 into the pressure chamber of the other cylinder at the front side of the piston. The small amount of hydraulic fluid which is discharged through the directional control valves 62, 63 provides for a temporary speed difference between the suction stroke and the pressure stroke. Following the closing of the directional control valve 63, the two cylinders $\mathbf{9}_1$ and $\mathbf{9}_2$ will move at the same speed until the cylinder in the suction stroke mode reaches its final position. The cylinder which is in the pressure stroke mode has not yet reached its final position, due to the above-mentioned speed differences at the beginning of the movement. At this time, the 4/3-port directional control valve switches into the position shown in FIG. 11, and the 3/2-port directional control valve 60 also into the position shown in FIG. 11. Hence, pump 13 is connected via line 15, line 59 and line 61 to the pressure chambers of cylinders $\mathbf{9}_1$ and $\mathbf{9}_2$ which are provided at the front side of the piston. As a result, both pistons $\mathbf{11}_1$ and $\mathbf{11}_2$ will perform a pressure stroke at the same speed until the cylinder which has been in the pressure stroke mode right from the beginning has reached its final position. During this time, the slide 7 is also operated via the directional control valve 20. The counter-stroke is then performed in the reverse order. The embodiment shown in FIG. 11 makes it possible to control the whole process with only one single pump 13.

I claim:

1. A method comprising: feeding thick materials from a container into a feeding pipe via two feeding cylinders which are alternately connectable by a switching device to said container or to said feeding pipe, with feeding pistons of said feeding cylinders alternately performing a suction stroke and a pressure stroke, wherein the average piston speed $V_3$ during the suction stroke is at least temporarily greater than during the pressure stroke, wherein, during a switching period $t_u$ of said switching device, the two feeding cylinders are substantially separated from said container at least temporarily and are short-circuited together to form a joint connection with said feeding pipe, wherein, during the switching period $t_u$, one of said feeding pistons is still finishing its pressure stroke and the other of said feeding pistons begins its pressure stroke, wherein said one feeding piston only performs its suction stroke when the short-circuit is substantially cancelled again and the feeding cylinder associated with said one feeding piston is connected to said container, wherein, said short-circuit is established by a single switching device which, during short circuiting, separates said two feeding cylinders from said container, wherein said one feeding piston begins its pressure stroke during a time interval $\Delta t$ of the switching period $t_u$, while said other feeding piston has not yet finished its pressure stroke, and wherein said other feeding piston travels at a first speed $V_2$ during a portion of its pressure stroke occurring in said time interval $\Delta t$ and thereafter increases speed, and wherein said first speed $V_2$ is smaller than the average speed $V_1$ of said other piston during a remainder of its pressure stroke.

2. A method comprising: feeding thick materials from a container into a feeding pipe via two feeding cylinders which are alternately connectable by a switching device to said container or to said feeding pipe, with feeding pistons of said feeding cylinders alternately performing a suction stroke and a pressure stroke, wherein the average piston speed $V_3$ during the suction stroke is at least temporarily greater than during the pressure stroke, wherein, during a switching period $t_u$ of said switching device, the two feeding cylinders are substantially separated from said container at least temporarily and are short-circuited together to form a joint connection with said feeding pipe, wherein, during the switching period $t_u$, one of said feeding pistons is still finishing its pressure stroke and the other of said feeding pistons begins its pressure stroke, wherein said one feeding piston only performs its suction stroke when the short-circuit is substantially cancelled again the feeder cylinder associated with said one feeding piston is connected to said container, wherein said short-circuit is established by a single switching device which, during short circuiting, separates said two feeding cylinders from said container, wherein said one feeding piston begins its pressure stroke during a time interval $\Delta t$ of the switching period $t_u$ while said other feeding piston has not yet finished its pressure stroke, and wherein, during time interval $\Delta t$, both feeding pistons move at substantially half the average speed $V_1$ of the remaining pressure stroke.

3. An apparatus for feeding thick materials, comprising: (1) at least two feeding cylinders which each have a feeding piston that alternately performs a suction stroke and a pressure stroke; (2) a switching device which alternately connects said feeding cylinders to a container or to a feeding pipe, said switching device comprising a pivot pipe which is pivotable with an inlet opening thereof alienable with mouth openings of said feeding cylinders, wherein said inlet opening and surrounding closing regions of said pivot pipe are designed such that, during a switching operation, said feeding cylinders are substantially short-circuited together with said feeding pipe but are substantially separated from said container; and (3) a separate cylinder/piston unit which drives each of said feeding pistons, and wherein each of said cylinder/piston units can be fed with pressurized fluid via a separate pump.

4. The apparatus according to claim 3, wherein said inlet opening is shaped as a substantially elongated hole bent around the pivot axis of said pivot pipe, and has a length L which corresponds approximately to the outer distance A of the mouth openings.

5. The apparatus according to claim 3, wherein said closing regions are arranged in an extension of said inlet opening and have a width C which substantially corresponds to the diameter D of said mouth openings.

6. The apparatus according to claim 3, wherein said pivot pipe is pivoted via operation of a slide actuated via a controlled two-way valve which is connected to a pump and/or an accumulator.

7. An apparatus for feeding thick materials, comprising: (1) at least two feeding cylinders which each have a feeding piston that alternately performs a suction stroke and a pressure stroke; (2) a switching device which alternately connects said feeding cylinders to a container or to a feeding pipe, said switching device comprising a pivot pipe which is pivotable with an inlet opening thereof alignable with mouth openings of said feeding cylinders, wherein said inlet opening and surrounding closing regions of said pivot pipe are designed such that, during a switching operation, said feeding cylinders are substantially short-circuited together with said feeding pipe but are substantially separated from said container; and (3) a separate cylinder/piston unit which drives each of said feeding pistons and which includes a cylinder, and wherein a selectively switchable line of a first pump is connectable to or separable from a first chamber of each cylinder at a piston rod side thereof, and further comprising a second pump which supplies pressurized fluid to a pressure chamber of each of said cylinders located at a front side of the associated piston, wherein said second pump is connectable, via a switchable line, either individually or jointly to said pressure chambers of said cylinders, and wherein the first chambers of said cylinders are jointly connectable to a pressurized-fluid return device.

8. An apparatus for feeding thick materials, comprising: (1) at least two feeding cylinders which each have a feeding piston that alternately performs a suction stroke and a pressure stroke; (2) a switching device which alternately connects said feeding cylinders to a container or to a feeding pipe, said switching device comprising a pivot pipe which is pivotable with an inlet opening thereof alienable with mouth openings of said feeding cylinders, wherein said inlet opening and surrounding closing regions of said pivot pipe are designed such that, during a switching operation, said feeding cylinders are substantially short-circuited together with said feeding pipe but are substantially separated from said container; and (3) a separate cylinder/piston unit which drives each of said feeding pistons, wherein a selectively switchable line of a first pump is connectable, via a respective adjustable flow divider, jointly to a pressure chamber of each cylinder located at a front side of the associated piston and to another chamber of each cylinder located at a piston rod side of said piston, or is separable therefrom, and further comprising a second pump that supplies pressurized fluid to the pressure chambers and that is connectable, via a switchable line, either individually or jointly to said pressure chambers, wherein lines of said flow dividers which lead to said pressure chambers are respectively connectable jointly with said pressure chambers, or can be blocked together, and wherein said flow dividers are jointly connectable to a pressurized-fluid return device when said flow dividers are separated from said first pump.

9. An apparatus for feeding thick materials, comprising: (1) at least two feeding cylinders which each have a feeding piston that alternately performs a suction stroke and a pressure stroke; (2) a switching device which alternately connects said feeding cylinders to a container or to a feeding pipe, said switching device comprising a pivot pipe which is pivotable with an inlet opening thereof alienable with mouth openings of said feeding cylinders, wherein said inlet opening and surrounding closing regions of said pivot pipe are designed such that, during a switching operation said feeding cylinders are substantially short-circuited together with said feeding pipe but are substantially separated from said container; and (3) a separate cylinder/piston unit which drives each of said feeding pistons, each of said units including a selectively switchable line of a pump which is connectable to or separable from a chamber of each cylinder provided at a piston rod side, wherein a second, selectively switchable line of said pump is jointly connectable to or separable from pressure chambers of said cylinders provided at a front side of said piston, wherein the pressure chambers are interconnected via a line, and wherein the pressure chambers are connectable to or separable from a pressurized-fluid return device via a selectively switchable line.

* * * * *